United States Patent [19]

Ingestrom

[11] 3,956,859

[45] May 18, 1976

[54] FOUNDATION OF A HEATED BUILDING WITHOUT A CELLAR

[75] Inventor: Irma Ulla Birgitta Ingeström, Alvangen, Sweden

[73] Assignee: A. B. Grona & Company KB, Alvangen, Sweden

[22] Filed: May 6, 1974

[21] Appl. No.: 467,531

[30] Foreign Application Priority Data

May 29, 1973 Sweden ..... 7307554

[52] U.S. Cl. ..... 52/169 R; 52/292; 52/294

[51] Int. Cl.[2] ..... E02D 27/02

[58] Field of Search ..... 52/169, 293, 294, 295

[56] References Cited

UNITED STATES PATENTS

| | | | |
|---|---|---|---|
| 844,296 | 2/1907 | Winslow | 52/169 |
| 2,068,831 | 1/1937 | Washburn | 52/169 |
| 2,835,126 | 5/1958 | Paolella | 52/169 |
| 2,978,779 | 4/1961 | Tatsch | 52/169 |
| 2,978,840 | 4/1961 | Tatsch | 52/169 |
| 3,237,357 | 3/1966 | Hutchings | 52/169 |
| 3,385,016 | 5/1968 | Crom | 52/293 |
| 3,555,979 | 1/1971 | Veder | 52/169 |
| 3,561,175 | 2/1971 | Best | 52/294 |
| 3,673,750 | 7/1972 | Bokvist | 52/292 |
| 3,820,295 | 6/1974 | Folley | 52/293 |
| 3,848,376 | 11/1974 | Elmore | 52/293 |

FOREIGN PATENTS OR APPLICATIONS

| | | | |
|---|---|---|---|
| 6681/32 | 3/1933 | Australia | 52/169 |
| 1,272,187 | 8/1961 | France | 52/293 |

*Primary Examiner*—Ernest R. Purser
*Assistant Examiner*—Henry Raduazo
*Attorney, Agent, or Firm*—Jones, Tullar & Cooper

[57] ABSTRACT

In a foundation of a heated building without a cellar, including prefabricated heat and damp insulating blocks following the contour of the outer walls of the building the blocks are structurally connected with a bottom layer of structural concrete with longitudinal reinforcement bars and on top of the blocks there is provided and connected therewith a longitudinally reinforced strand of structural concrete. The blocks form together with the strand and the bottom layer a longitudinally reinforced edge beam in the foundation, the blocks forming the web of the beam.

4 Claims, 2 Drawing Figures

FOUNDATION OF A HEATED BUILDING WITHOUT A CELLAR

Figure 2:
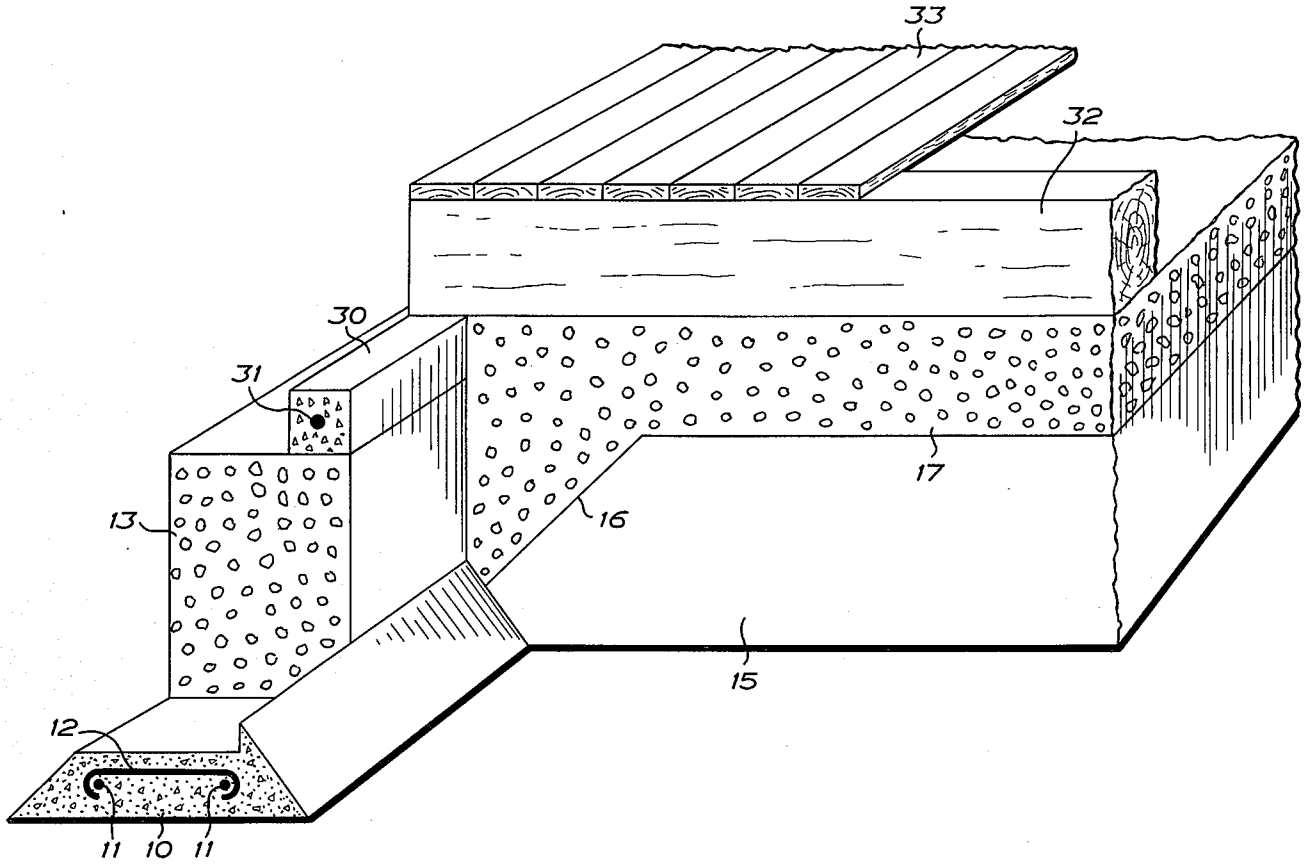

The invention relates to a foundation of a heated building without a cellar.

According to a prior art method the foundation of heated buildings without a cellar is laid by disposing on the levelled or smoothed ground prefabricated heat and damp insulating blocks of light clinker concrete (light concrete blocks with a ballast of light clinker i.e., expanded burnt clay) in a configuration following the contour of the outer walls of the building which are to be supported on said blocks. Then, on top of an insulating layer of light clinker placed on the ground inside the blocks, a flooring slab of structural concrete is poured which will adhere to and thereby be connected with said blocks.

It is considered advantageous to lay the foundation in this way since no excavation for the foundation to an unfrozen depth will be required in order to arrange the blocks. It is sufficient to excavate possible tilth and to level or smooth the ground.

Despite this simple way of laying the foundation there will be no problems due to frost damages since heat from the interior of the heated building is led over the flooring slab through the underlying insulating layer of light clinker to the ground under the blocks, so that the ground there will be kept unfrozen even at a temperature below the freezing point. Due to the supply of heat from the interior of the building a heated zone will form under the blocks.

When laying the foundation according to the prior art method the weight of the walls resting on the blocks will not be taken up directly by the ground under the blocks but will be led through the adhesion joint between the blocks and the flooring slab, first to the flooring slab and then to the insulating layer of light clinker and further on to the ground under said layer. Therefore it is required that the adhesion surface between the flooring slab and the blocks is made relatively large which means that the thickness of the ground slab will be progressively increased towards the edge thereof adhering to the blocks, in an outer marginal zone. Thereby a substantial cold bridge will be provided between the flooring slab and the blocks resulting in a heat loss in the marginal zone of the flooring slab of such a magnitude that the minimum requirements of health conditions cannot be satisfied.

It is an object of the invention to eliminate this drawback and at the same time to simplify the laying of the foundation by utilizing the blocks in a new way to directly take up the pressure from the outer walls of the buildings without the flooring slab acting as an intermediary, thereby dispensing with the thicker portion of the flooring slab in the marginal zone thereof serving as a cold bridge.

In order to achieve this object there is provided according to the invention a foundation of a heated building without a cellar, including prefabricated heat and damp insulating blocks following the contour of the outer walls of the building, and a heat and damp insulating layer of light clinker, disposed inside the blocks, with an overhead flooring slab which is connected with the foundation elements, said layer being disposed inside the blocks, characterized in that the blocks are disposed on and poured together with a bottom layer made of structural concrete with longitudinal reinforcement bars, said bottom layer extending along the blocks, and in that the flooring slab rests on the blocks with a longitudinally reinforced strand of structural concrete which is poured together with the blocks so that the strand and the bottom layer together with the blocks will form a longitudinally reinforced edge beam in the foundation, the blocks forming the web of the beam.

Figure 1:
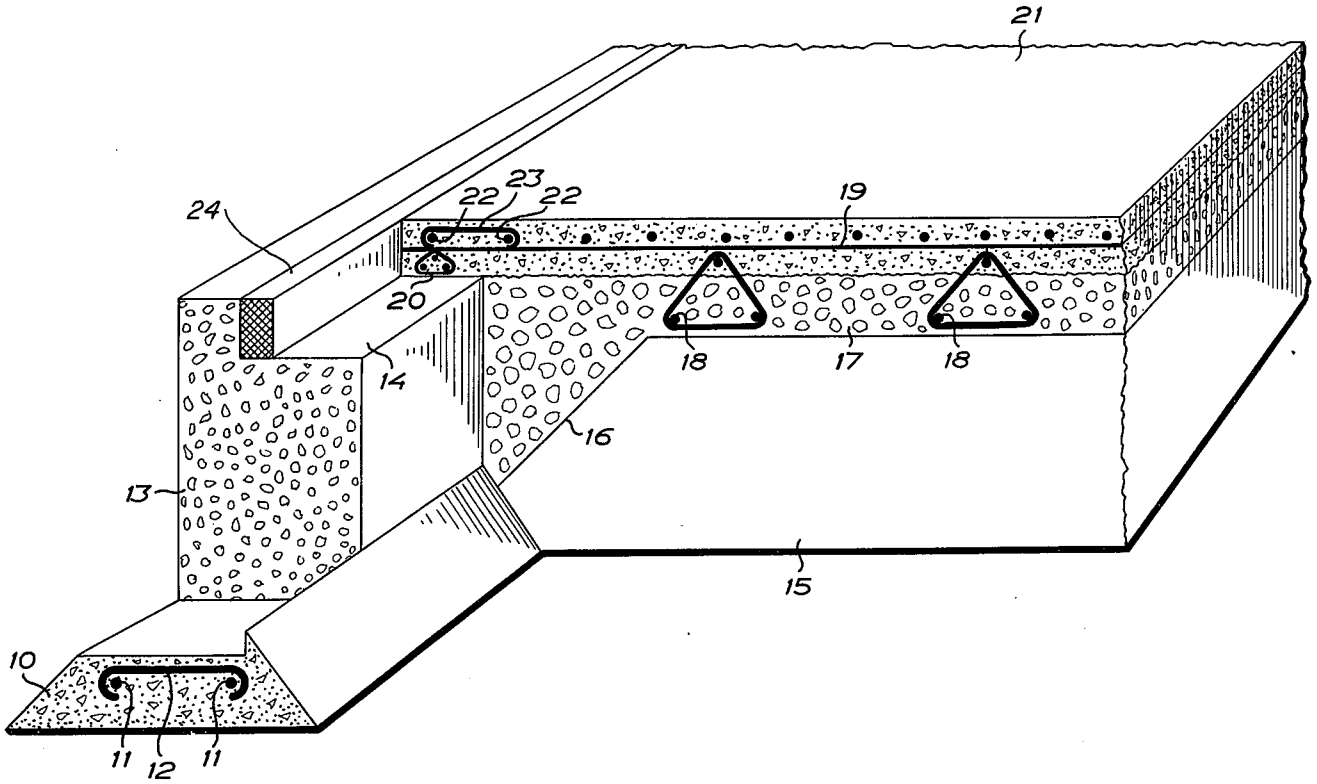

An embodiment of the invention will be described in detail below with reference to the enclosed drawings in which FIG. 1 is a perspective sectional view of an embodiment of a foundation according to the invention, and FIG. 2 is a corresponding view of another embodiment thereof.

According to FIG. 1 a bottom layer 10 of structural concrete is poured directly on the ground after the ground has been levelled or smoothed at least where the outer walls of the building are to be placed, said bottom layer being provided with internal longitudinal reinforcement bars 11 and possibly also with transverse reinforcement bars 12. The bottom layer should follow the contour of the outer walls of the building. Blocks 13 made of light clinker concrete (light concrete with a ballast of light clinker) are placed in the wet concrete to form a sleeper or foundation wall and are thereby fixed to the bottom layer. Said blocks should be of such height, width and length that they may easily be lifted by one person without special auxiliary equipment. On the top of each block there is a rectangular edge recess 14 extending along the entire length thereof, each block being arranged with said recess on the inside of the foundation wall formed by the blocks so that said wall will be provided with a longitudinal edge flange on its inside. Inside the bottom layer and the blocks disposed thereon the ground will form an elevation 15 or such an elevation will be provided by filling and hardening (vibrating). The elevation slopes down towards the bottom layer at 16 and its top surface will be at such a distance below the level defined by the horizontal surface of the recess 14 which corresponds to the desired thickness of a heat or damp insulating layer 17 which is formed in light clinker and which will increase along the surface 16 of elevation 15 to a thickness corresponding to the height of blocks 13 on the inside thereof.

According to prior art methods of foundation, the heat and damp insulating layer of light clinker thus placed directly on the ground has been surface stabilized or entirely cement bound for hardening of the insulating layer since the light clinker granules which are usually spherical will be quite useless as a working and reinforcement support if they are placed loosely. Such surface stabilization or cement binding will not be needed in the foundation according to the invention. In the shown embodiment, on elevation 15 there are disposed, before the insulating layer 17 is laid out, a number of reinforcement trestles 18. Said reinforcement trestles will operate as spacers to support a reinforcing netting 19 which is furthermore supported by a reinforcement trestle 20 which is disposed on the horizontal surface of the recess 14. The layer of light clinker may be laid out before the reinforcing netting is installed but also after that in the case that the light clinker is blown into the space contained within the foundation wall. A flooring slab 21 made of structural concrete is poured on insulating layer 17, the reinforcement trestles 18 and 20 holding the reinforcing netting in the correct position in said flooring slab and at the same time serving as a fender for the concrete which will fall loosely when the flooring slab is poured so that there will be no movement in the insulating layer 17. The portion of flooring slab 21 extending over the horizontal surface of recess 14 will be provided with internal longitudinal reinforcement bars 22 and possibly transverse reinforcement bars 23. The width of the portion of the block projecting upwards on the outer side thereof (the portion which remains adjacent the recess 14) should be of adequate size to provide the required heat and damp insulation. However, between flooring slab 21 and the vertical surface of recess 14 there may be optionally disposed a layer 24 of a highly heat and damp insulating material.

From a constructional point of view the described embodiment of the foundation will operate effectively as a beam due to the presence of reinforcement 11 in bottom layer 10 and reinforcement 22 in flooring slab 21 since these reinforcements are mutually spaced at a great distance in elements 10, 13, and 21, which are poured together and which form a longitudinal reinforcement edge beam in which blocks 13 form a web between top and bottom flanges (flooring slab 21 and bottom layer 10, respectively). From a constructional point of view the blocks are thereby utilized in a new way. Since the structural concrete in the bottom layer and the flooring slab, respectively, will enclose reinforcements 11 and 22, respectively, and since there is provided an efficient adhesion between the bottom layer and the blocks on one hand, and between the flooring slab and the blocks on the other, the lower compression strength which is characteristic of blocks of this quality and which distinguishes them from conventional concrete foundation may be utilized to directly transfer the weight of the outer walls subsequently built on the blocks and, to some part, on the flooring slab through the blocks and the bottom layer to the underlying ground.

The width of block 13 is adapted to meet the requirements of sufficient heat insulation by reducing the heat losses through the structural concrete in the flooring slab joining the blocks, due to the elimination or reduction of the cold bridge between the flooring slab and the blocks. Thanks to the increased thickness of insulating layer 17 in the marginal zone thereof, the insulation will be further improved. The insulating layer 17 has been provided with this form to drive down the heat below the bottom layer and thereby effectively keeping the ground under the foundation wall unfrozen. In this way there will be no difficulties in keeping cold and damp away from the interior of the building in the marginal zone of the flooring slab 21, joining the blocks.

The foundation shown in FIG. 2 comprises as described above a bottom layer 10 of structural concrete with longitudinal reinforcement bars 11 and cross reinforcement bars 12, blocks 13 made of light clinker concrete adhering to the bottom layer. In this case, on top of the blocks there is a beam 30 made of structural concrete with longitudinal reinforcement bars 31, said beam adhering to the blocks and being disposed adjacent the inner side of the blocks to extend along the foundation wall formed by the blocks. On the beam there is placed a framing of wooden beams or joists 32 which are fixed to beam 30, and floor boards 33 disposed on the wooden beams or joists. Instead of a wooden framing a framing made of concrete elements may be provided. Inside blocks 13 there is provided an elevation 15 sloping down towards the bottom layer at 16, and a heat and damp insulating layer 17 made of light clinker fills the space between the ground and the wooden beams or joists 32.

From a constructional point of view the framing according to FIG. 2 will operate as a cantilever framing but, from a thermotechnical point of view, as a flooring slab on the ground which will require, however, a foundation depth of only 25 to 35 centimeters against 90 to 180 centimeters for a conventional cantilever framing. Here the light clinker will not only operate as a heat and damp insulator in the way described in connection with FIG. 1 but will also operate as a sound absorbing layer which will eliminate the sound of steps on the wooden floor.

In comparison with the embodiment according to FIG. 1 the embodiment described in connection with FIG. 2 will provide the advantage that it may be built at any temperature. A concrete slab, on the other hand, must be poured in its entirety on the building site and this can only be achieved at temperatures above a certain value.

I claim:

1. A foundation of a heated building without a cellar, including prefabricated heat and damp insulating blocks following the contour of the outer walls of the building, a bottom layer made of structural concrete with longitudinal reinforcement bars and extending along the blocks, the blocks being disposed on said bottom layer while said layer is wet, a heat and damp insulating layer of light clinker disposed inside the blocks, an overhead flooring slab made of structural concrete and having a longitudinally reinforced marginal portion, said blocks having their inner edges recessed along their entire length at the top thereof, and said longitudinally reinforced marginal portion of said flooring slab being disposed on top of said blocks in said recesses thereof whereby said flooring slab forms together with said bottom layer and said blocks a longitudinally reinforced edge beam in the foundation, the blocks forming the web of the beam.

2. A foundation according to claim 1, further comprising a heat and damp insulating layer between the edge surface of the floor slab and the blocks.

3. A foundation according to claim 2, further comprising reinforcement of the floor slab in addition to said longitudinally reinforced marginal portion, trestles arranged as spacers and supporting said reinforcement, said trestles resting on the ground supporting the insulating layer made of light clinker.

4. A foundation according to claim 3, wherein the insulating layer made of light clinker is of a thickness increasing towards the blocks in a marginal zone to extend over the major portion of the height of the blocks.

* * * * *